US006450774B1

(12) United States Patent
Erbes et al.

(10) Patent No.: US 6,450,774 B1
(45) Date of Patent: Sep. 17, 2002

(54) METHOD AND SYSTEM FOR A JET PUMP SLIP JOINT OVALIZATION

(75) Inventors: John Geddes Erbes, Mountain View, CA (US); James Hibbert Oates, Gilroy, CA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/746,410

(22) Filed: Dec. 21, 2000

(51) Int. Cl.[7] ..... F04F 5/00
(52) U.S. Cl. ..... 417/151; 403/11
(58) Field of Search ..... 417/151; 29/890.031; 403/11

(56) References Cited

U.S. PATENT DOCUMENTS

| | | | | |
|---|---|---|---|---|
| 1,400,801 A | * | 12/1921 | Cohen | 269/25 |
| 4,285,770 A | | 8/1981 | Chi et al. | |
| 5,839,192 A | * | 11/1998 | Weems et al. | 29/890.031 |
| 5,876,146 A | * | 3/1999 | Deaver et al. | 403/11 |
| 5,978,433 A | | 11/1999 | Erbes et al. | |
| 6,052,425 A | | 4/2000 | Erbes et al. | |
| 6,053,652 A | | 4/2000 | Deaver et al. | |

FOREIGN PATENT DOCUMENTS

JP 11-32658 6 * 11/1999

* cited by examiner

*Primary Examiner*—Charles G. Freay
*Assistant Examiner*—Michael K. Gray
(74) *Attorney, Agent, or Firm*—Armstrong Teasdale LLP

(57) ABSTRACT

A method for applying a lateral support load to a jet pump slip joint. The method includes positioning an ovalization device around the diffuser and actuating the ovalization device to apply a predetermined load to the slip joint which creates an oval deformation of the diffuser. The force applied by the ovalization device creates a plastic strain in the diffuser wall which permits the diffuser to maintain an oval shape, and an elastic strain in the wall of the inlet mixer. The elastic deflection of the inlet mixer which is restrained from its original shape applies a lateral preload force to the diffuser at the area where the diffuser has a reduced diameter due to the oval deformation. This lateral preload force maintains a rigid contact between the inlet mixer and the diffuser collar to prevent oscillating motion and suppress FIV.

17 Claims, 3 Drawing Sheets

METHOD AND SYSTEM FOR A JET PUMP SLIP JOINT OVALIZATION

BACKGROUND OF THE INVENTION

This invention relates generally to nuclear reactors, and more particularly to jet pump slip joint ovalization for boiling water nuclear reactors.

A reactor pressure vessel (RPV) of a boiling water reactor (BWR) typically has a generally cylindrical shape and is closed at both ends, e.g., by a bottom head and a removable top head. A top guide typically is spaced above a core plate within the RPV. A core shroud, or shroud, typically surrounds the core and is supported by a shroud support structure. Particularly, the shroud has a generally cylindrical shape and surrounds both the core plate and the top guide. There is a space or annulus located between the cylindrical reactor pressure vessel and the cylindrically shaped shroud.

In a BWR, hollow tubular jet pumps positioned within the shroud annulus, provide the required reactor core water flow. The upper portion of the jet pump, known as the inlet mixer, is laterally positioned and supported against two opposing rigid contacts within restrainer brackets by a gravity actuated wedge. The restrainer brackets support the inlet mixer by attaching to the adjacent jet pump riser pipe. The lower portion of the jet pump, known as the diffuser, is coupled to the inlet mixer by a slip joint. The slip joint between the jet pump inlet mixer and the jet pump diffuser collar has about 0.015 inch diametral operating clearance which accommodates the relative axial thermal expansion movement between the upper and lower parts of the jet pump and permits leakage flow from the driving pressure inside the pump.

Excessive leakage flow can cause oscillating motion in the slip joint, which is a source of detrimental vibration excitation in the jet pump assembly. The slip joint leakage rate can increase due to single loop operation, increased core flow, or jet pump crud deposition. The restrainer bracket laterally supports the inlet mixer through three point contact provided by two set screws and the inlet mixer wedge at an elevation above the slip joint. Set screw gaps can occur during plant operation. Sometimes, the inlet mixer appears to settle to a position away from the set screw, while in other cases, wear occurs between the mixer wedge and the restrainer pad. In both cases, three point contact is lost and the potential for vibration is significantly increased. Set screw gaps are affected by the difference in thermal and pressure displacements of the shroud, pressure vessel, and rotation of the shroud support plate. In addition to affecting set screw gaps, thermal and pressure displacements of the shroud and the pressure vessel can diminish alignment interaction loads in the jet pump assembly which are beneficial in restraining vibration, such as a lateral force in the slip joint. The resultant increased vibration levels and corresponding vibration loads on the piping and supports can cause jet pump component degradation from wear and fatigue.

High levels of flow induced vibration (FIV) is possible in some jet pump designs at some abnormal operational conditions having increased leakage rates. Therefore, it is desirable to provide a jet pump assembly that that has a lateral load in the slip joint area to maintain rigid contact between the inlet mixer and the diffuser collar to prevent oscillating motion and suppress FIV.

BRIEF SUMMARY OF THE INVENTION

A method for applying a lateral support load to a jet pump slip joint in accordance with an exemplary embodiment of the present invention includes creating an oval deformation of the jet pump diffuser. The jet pump includes a jet pump inlet mixer and a jet pump diffuser joined together by a slip joint. A bottom end of the inlet mixer is inserted into a top end of the diffuser to form the slip joint. The wall of the inlet mixer having a smaller thickness than the wall of the diffuser.

The method includes positioning an ovalization device around the diffuser and actuating the ovalization device to apply a predetermined load to the slip joint which creates an oval deformation of the diffuser. The force applied by the ovalization device creates a plastic strain in the diffuser wall which permits the diffuser to maintain an oval shape. Because of the thinner wall thickness of the inlet mixer, the applied force produces an elastic strain in the wall of the inlet mixer, which then attempts to restore its original circular shape when the load applied by the ovalization device is released. The elastic deflection of the inlet mixer as the mixer moves to its original shape applies a lateral preload force to the diffuser at the area where the diffuser has a reduced diameter due to the oval deformation. This lateral preload force maintains a rigid contact between the inlet mixer and the diffuser collar to prevent oscillating motion and suppress FIV. Also, the deformation is controlled so that the elastic deformation induced preload force is sufficient to prevent vibratory motion in the slip joint but does not cause excessive friction in the slip joint so as not to interfere with assembly and disassembly of the slip join or the required sliding to accommodate operating thermal expansion displacements.

DETAILED DESCRIPTION OF THE INVENTION

Figure 1:
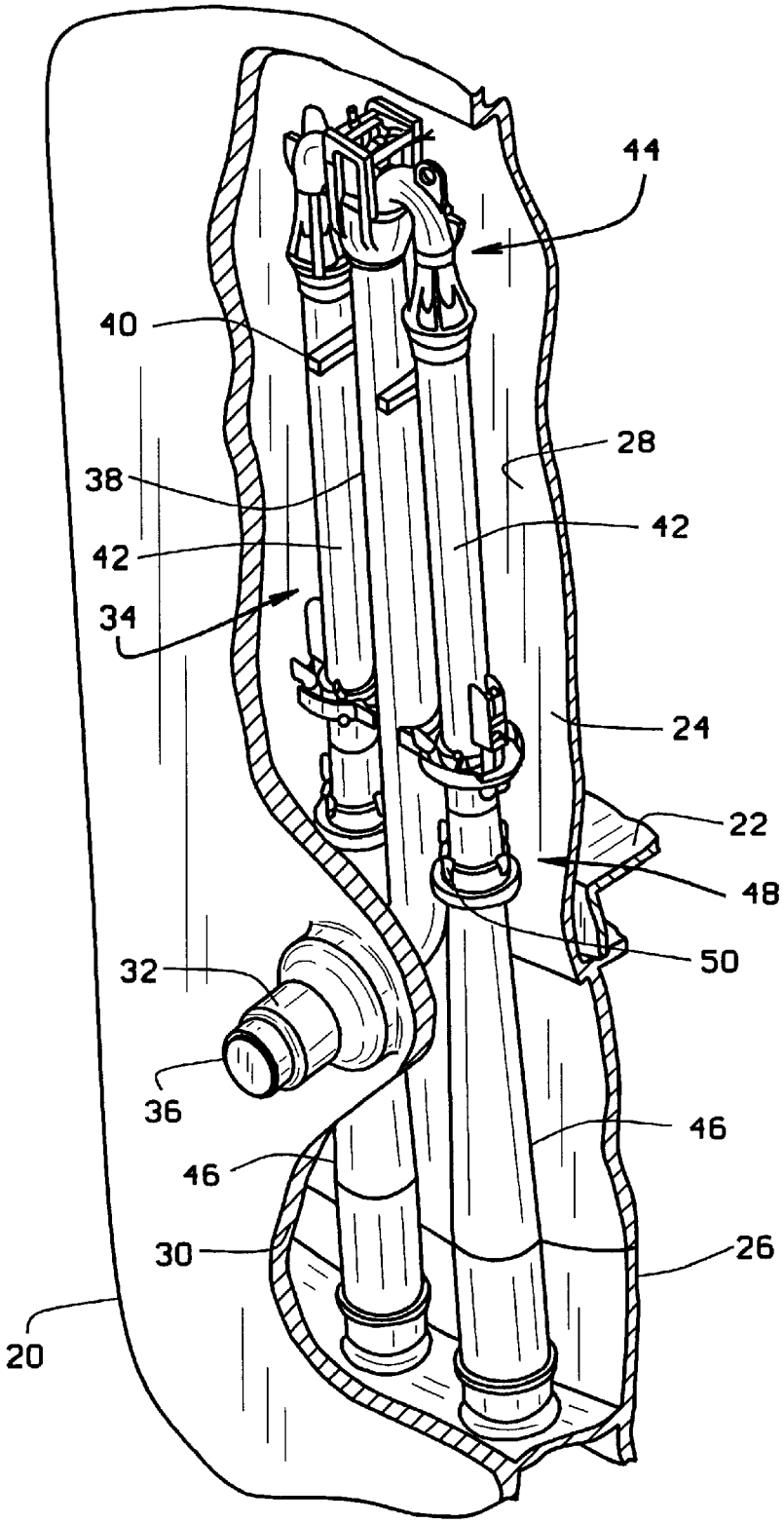
FIG. 1 is schematic, partial sectional view, with parts cut away, of a reactor pressure vessel of a boiling water nuclear reactor.

FIG. 1 is a schematic, partial sectional view, with parts cut-away, of a reactor pressure vessel (RPV) 20 for a boiling water reactor. RPV 20 has a generally cylindrical shape and is closed at one end by a bottom head (not shown) and at its other end by removable top head (not shown). A top guide (not shown) is spaced above a core plate 22 within RPV 20. A shroud 24 surrounds core plate 22 and is supported by a shroud support structure 26. An annulus 28 is formed between shroud 24 and side wall 30 of RPV 20.

An inlet nozzle 32 extends through side wall 30 of RPV 20 and is coupled to a jet pump assembly 34. Jet pump assembly 34 includes a thermal sleeve 36 which extends through nozzle 32, a lower elbow (only partially visible in FIG. 1), and a riser pipe 38. Riser pipe 38 extends between and substantially parallel to shroud 24 and RPV side wall 30. A riser brace 40 stabilizes riser pipe 38 within RPV 20.

Jet pump assembly 34 also includes a plurality of inlet mixers 42 connected to a plurality of riser pipes 38 by a plurality of transition assemblies 44. A slip joint 48 couples each inlet mixer 42 to a corresponding diffuser 46. Each diffuser 46 includes four guide ears 50 equally spaced around diffuser 46 at slip joint 48.

Figure 2:
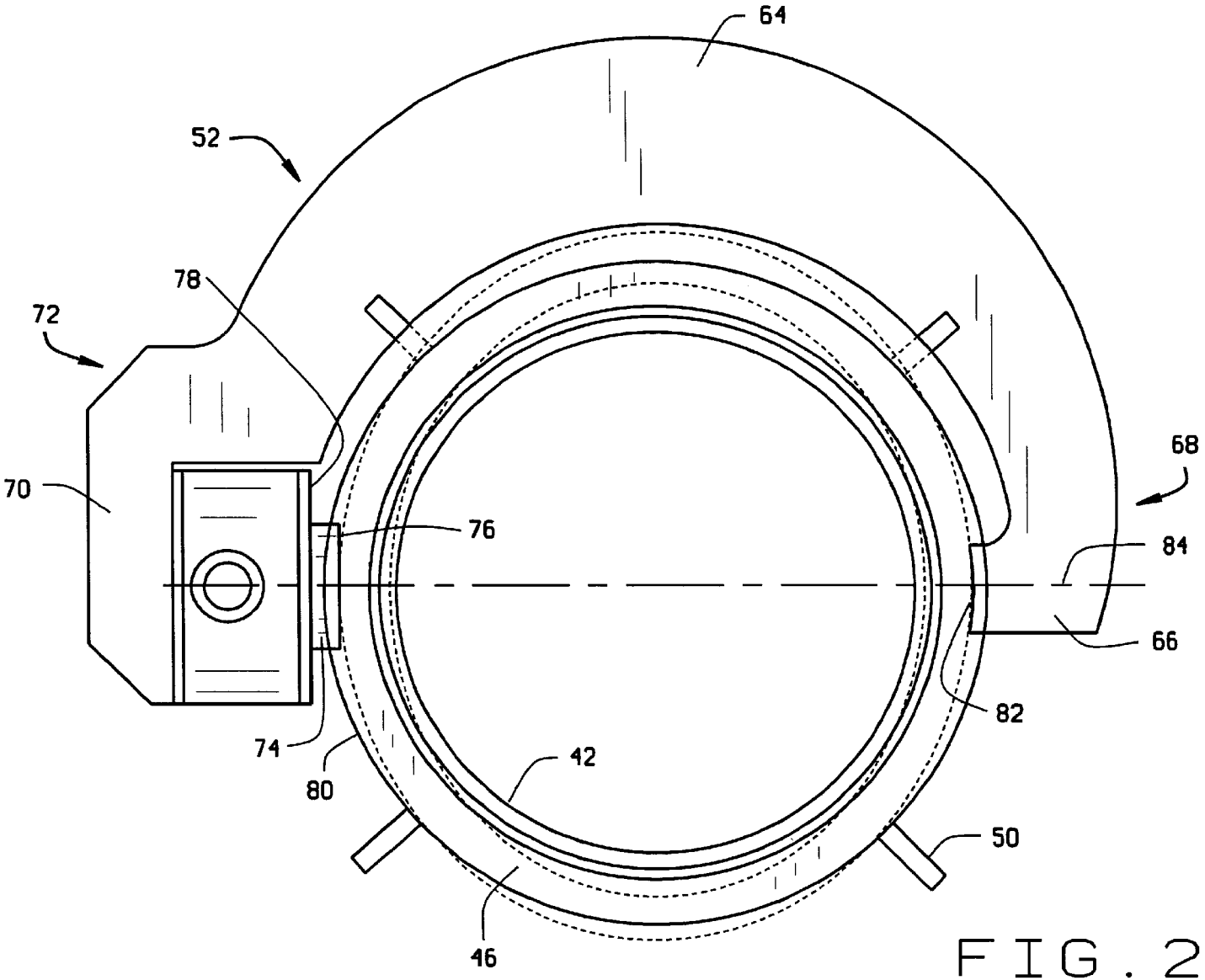
FIG. 2 is a top sectional view of a jet pump shown in FIG. 1 with a ovalization device positioned in accordance with an embodiment of the present invention.
Figure 3:
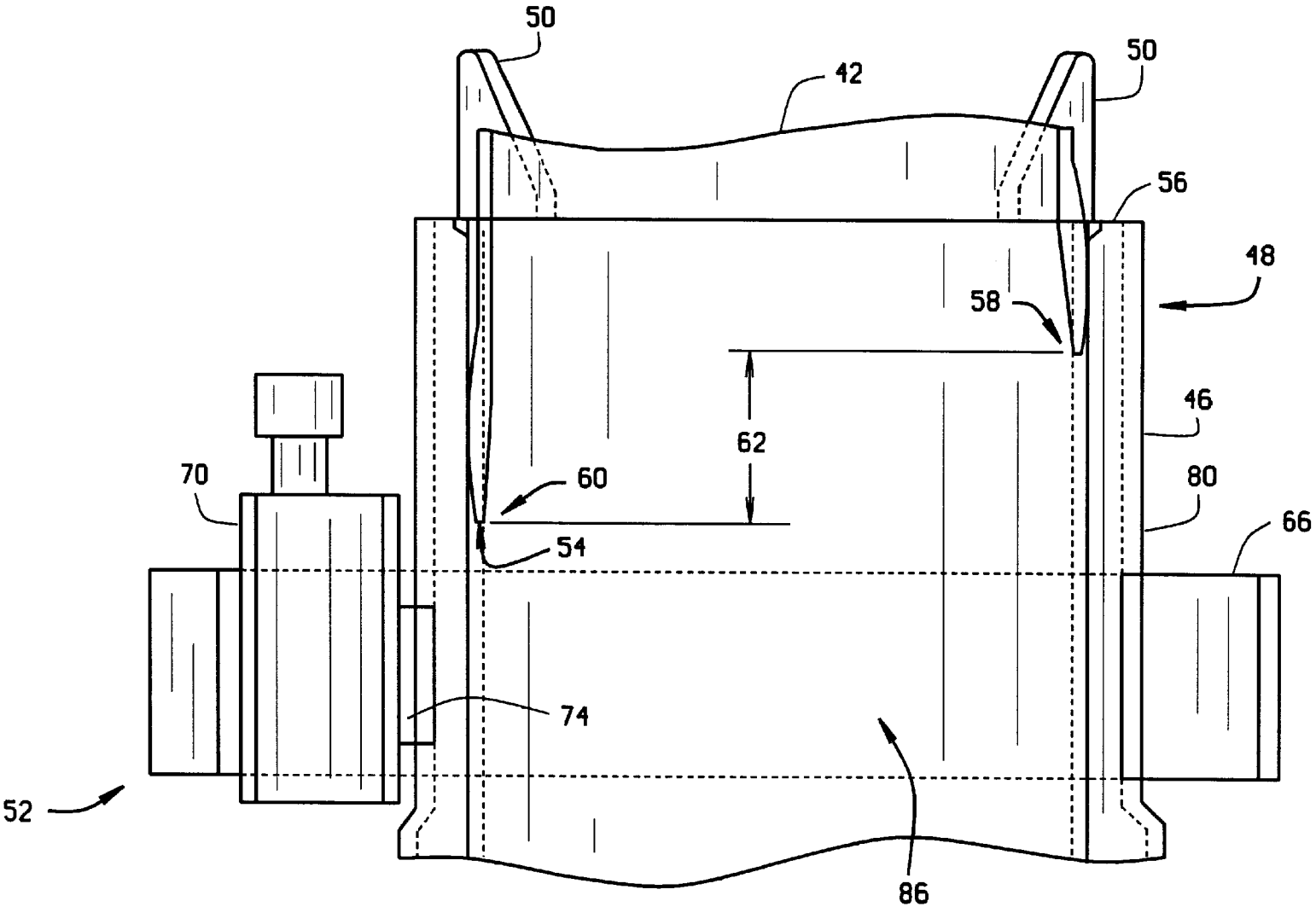
FIG. 3 is a front sectional view of the jet pump and ovalization device shown in FIG. 2.

FIG. 2 is a top sectional view of a ovalization device 52 attached to diffuser 46 of jet pump assembly 34 in accordance with an embodiment of the present invention. FIG. 3 is a side view of ovalization device 52 attached to diffuser 46. Referring to FIGS. 2 and 3, a bottom coupling end 54 of inlet mixer 42 extends into a top coupling end 56 of diffuser 46. Coupling end 54 of inlet mixer 42 extends into diffuser 46 between a first position 58 and a second position 60. The area between first position 58 and second position 60 is defined as a diffuser engagement area 62. During assembly of slip joint 48, bottom coupling end 54 of inlet mixer 42 is inserted into diffuser 46 so that first coupling end 54 is located within diffuser engagement area 62. Further, the wall thickness of diffuser 46 is greater than the wall thickness of inlet mixer 42.

Ovalization device 52 is a hydraulic C-yoke clamp having a substantially C-shaped cross section. Ovalization device 52 includes a curved or arcuate main portion 64, an engagement portion 66 extending from a first end 68 of main portion 64, and a clamp portion 70 extending from a second end 72 of main portion 64.

Clamp portion 70 includes a hydraulic cylinder 74 that is movable from a first position where an end 76 of cylinder 74 is flush with a first wall 78 of hydraulic portion 70 to a second position where end 76 is in contact with an outer surface 80 diffuser 46. Engagement portion 66 includes an inner surface 82 which engages outer surface 80 of diffuser 46.

In an alternative embodiment of ovalization device 52, clamp portion 70 comprises a screw jack having either a manual mechanical actuator or an gear motor drive. In a further alternative embodiment, ovalization device 52 has a circular configuration that is hinged to split into two or more segments. It is contemplated that the benefits of a slip joint ovalization accrue with an oval deformation created by any tool or clamp capable of creating the desired oval deformation.

Ovalization device 52 is remotely installed on slip joint 48 with cylinder 74 retracted. The installation of ovalization device 52 does not require disassembly of jet pump 34. Ovalization device 52 is installed such that clamp portion 70 is adjacent an outer surface 80 of diffuser 46, and engagement portion 66 is also adjacent outer surface 80 at a position approximately 180° circumferentially from the position of hydraulic portion 60. Clamp portion 70 and engagement portion 56 are positioned adjacent outer surface 80 outside engagement area 62. In another embodiment, clamp portion 70 and engagement portion 66 are positioned adjacent outer surface 80 within engagement area 62. Clamp portion 70 is activated such that end 76 of cylinder 74 moves from the first position adjacent first wall 78 toward the second position to contact outer surface 80 of diffuser 46. Specifically, diffuser 46 is squeezed between cylinder 74 and engagement portion 66 applying a loading force to diffuser 46 that causes an oval deformation of diffuser 46 and inlet mixer 42. The loading is such that after the loading is removed a residual oval deformation of diffuser 46 is achieved yet inlet mixer 42 is not residually deformed.

Because the wall thickness of inlet mixer 42 is thinner than the wall thickness of diffuser 46, the loading is such that a plastic strain is produced in diffuser 46, and an elastic strain is produced in inlet mixer 42. After the specified loading is removed, diffuser 46 is residually deformed but inlet mixer 42 is not residually deformed and attempts to spring back to a substantially circular pre-load position thus applying a spring pre-load to diffuser 46. This diametral pre-load interference eliminates any gaps between diffuser 46 and inlet mixer 42 along a lateral axis 84 of slip joint 48 and maintains a rigid contact between inlet mixer 42 and diffuser 46. Lateral axis 84 is substantially collinear with the position of clamp portion 70 and engagement portion 66 of ovalization device 52.

The amount of oval deformation is controlled so that the elastic deformation induced preload force is sufficient to prevent vibratory motion in slip joint 48 but does not cause excessive friction between inlet mixer 42 and diffuser 46 in slip joint 48 so as not to interfere with assembly and disassembly of slip joint 48 or the required sliding to accommodate operating thermal expansion displacements.

In an alternative embodiment, ovalization device 52 is positioned at a location, established by analysis or test, below diffuser engagement area 62 at a non-engagement area 86 so that the residual deformed shape of diffuser 56 has substantially no variation of ovality along engagement area 62.

The above described ovalization device 52 provides a lateral load to slip joint 48 of jet pump 34 to maintain a tight and rigid contact between inlet mixer 42 and diffuser 46 to reduce or prevent oscillating motion and suppress FIV. Also, ovalization device 52 is remotely installable, requires minimum installation time, and does not require disassembly of jet pump 34. Alternatively, ovalization device 52 can be utilized on either diffuser 46 or inlet mixer 42 whenever jet pump 34 is disassembled for maintenance or cleaning. In one embodiment, ovalization device 52 is utilized to apply a plastic strain on a diffuser before joining the diffuser to a substantially circular inlet mixer. In another embodiment, ovalization device 52 is utilized to apply a plastic strain on an inlet mixer before joining the mixer to a substantially circular diffuser. In either of these two embodiments, when the diffuser and inlet mixer are joined at the slip joint, a pre-load results from the plastic strain and, therefore, oscillating motion is reduced or eliminated.

While the invention has been described in terms of various specific embodiments, those skilled in the art will recognize that the invention can be practiced with modification within the spirit and scope of the claims.

What is claimed is:

1. A method for applying a lateral support load at a jet pump slip joint, the jet pump comprising a jet pump inlet mixer and a jet pump diffuser joined by a slip joint, the jet pump diffuser comprising an engagement area, said method comprising the steps of:

positioning an ovalization device around the diffuser, the ovalization device comprising an engagement portion and a clamp portion; and actuating the ovalization device such that a portion of the diffuser is deformed generating a plastic strain therein.

2. A method according to claim 1 wherein actuating the ovalization device further comprises the step of actuating the ovalization device such that the inlet mixer is deformed generating an elastic strain therein.

3. A method according to claim 1 wherein positioning an ovalization device further comprises the step of positioning the ovalization device around the diffuser below the engagement area of the diffuser.

4. A method according to claim 3 wherein positioning the ovalization device around the diffuser below the engagement area of the diffuser comprises the step of positioning the ovalization device around the diffuser below the engagement area of the diffuser at a position so that a residual deformed shape of said diffuser has substantially no variation of ovality along said diffuser engagement area.

5. A method according to claim 1 wherein positioning an ovalization device further comprises the step of positioning a ovalization device comprising a hydraulic C-yoke clamp around the diffuser.

6. A method in accordance with claim 1 wherein positioning an ovalization device comprises the step of positioning the ovalization device so that the engagement portion is positioned adjacent an outer surface of the diffuser and the clamp portion is positioned adjacent the outer surface of the diffuser so that the engaging portion and the clamp portion are located on a lateral axis of the slip joint.

7. A method according to claim 1 wherein positioning an ovalization device further comprises the step of positioning the ovalization device about the diffuser in the engagement area of the diffuser.

8. A method according to claim 1 wherein positioning an ovalization device further comprises the step of positioning a ovalization device comprising a screw jack C-yoke clamp around the diffuser.

9. A method according to claim 1 wherein positioning an ovalization device further comprises the step of positioning a ovalization device having a circular configuration hinged to split into at least two segments about the diffuser.

10. A jet pump for a boiling water nuclear reactor, said jet pump comprising:

an inlet mixer having a bottom coupling end; and a diffuser coupled to said inlet mixer by a slip joint, said diffuser having a top coupling end, at least one of said bottom coupling end and said top coupling end comprising a substantially oval shape.

11. A jet pump in accordance with claim 10 wherein said bottom coupling end comprising a substantially oval shape, said top coupling end comprising a substantially circular shape.

12. A jet pump in accordance with claim 10 wherein said bottom coupling end comprising a substantially circular shape, said top coupling end comprising a substantially oval shape.

13. A system for jet pump slip joint ovalization, said system comprising:

an inlet mixer having a bottom coupling end;

a diffuser having a top coupling end, said top coupling end coupled to said bottom coupling end by a slip joint; and a ovalization device configured to deform said top coupling end of said diffuser generating a plastic strain therein, said ovalization device positioned about said diffuser.

14. A system in accordance with claim 13 wherein said ovalization device is further configured to deform said bottom coupling end of said inlet mixer generating an elastic strain therein.

15. A system in accordance with claim 13 wherein said ovalization device comprises a hydraulic C-yoke clamp.

16. A system in accordance with claim 13 wherein said ovalization device comprises a screw jack C-yoke clamp.

17. A system in accordance with claim 13 wherein said ovalization device is circularly hinged to split into at least two segments.

* * * * *